US005996159A

United States Patent [19]

Irwin

[11] Patent Number: 5,996,159

[45] **Date of Patent: *Dec. 7, 1999**

[54] WASTE LINE INSPECTION AND CLEAN OUT DEVICE WITH WATER JET HEAD

[76] Inventor: Lawrence F. Irwin, 12860 San Fernando Rd., Sylmar, Calif. 91342

[ * ] Notice: This patent is subject to a terminal disclaimer.

[21] Appl. No.: 09/233,858

[22] Filed: Jan. 20, 1999

Related U.S. Application Data

[63] Continuation of application No. 08/893,994, Jul. 16, 1997, Pat. No. 5,862,561.

[51] Int. Cl.[6] ..... B08B 9/02

[52] U.S. Cl. ..... 15/104.33; 15/104.31; 134/113; 134/168 C

[58] Field of Search ..... 15/3.5, 93.1, 104.31, 15/104.32, 104.33; 134/113, 167 C, 168 C

[56] References Cited

U.S. PATENT DOCUMENTS

| | | | |
|---|---|---|---|
| 3,959,840 | 6/1976 | Sato | 15/104.33 |
| 4,312,679 | 1/1982 | Klein | 15/104.33 |
| 4,661,848 | 4/1987 | Matsuda | 15/3.5 |
| 5,193,242 | 3/1993 | Irwin | 15/104.33 |
| 5,199,129 | 4/1993 | Salecker et al. | 15/104.33 |
| 5,535,473 | 7/1996 | Maniar | 15/104.33 |
| 5,862,561 | 1/1999 | Irwin | 15/104.33 |

*Primary Examiner*—Terrence R. Till
*Attorney, Agent, or Firm*—James E. Brunton

[57] ABSTRACT

A power driving waste line clean out tool which includes an elongated flexible coil spring formed from an elongated spring wire that is helically wound about a flexible water conduit. The water conduit provides water under relatively high pressure to a uniquely designed water jet clean out head assembly that is affixed to the end of the coil spring and is adapted to effectively break up and remove blockages formed in the sewer line being cleaned. A portion of the flexible coil spring is housed within a drum having a conoidal wall through which the coil spring is provided with a feed mechanism and is fed and retracted actually of itself as the drum is rotated. The water jet head assembly of the tool includes a spray head which can be securely connected to the coil spring, a cutter head assembly which can be removably interconnected with the spray head and a connector means of unique design for interconnecting the water conduit of the coil spring assembly with the plurality of water jets provided in the spray head and extending angularly outwardly relative to longitudinal axis of the waste line. Also provided proximate the outboard end of the coil spring assembly is a small video camera which is interconnected with a monitor carried by the frame of the device. Power, ground and fiber optic signal transmitting conduits for operating the video camera are carried within the flexible water conduit so that the blockage and the interior of the waste line can be clearly viewed by the operator.

15 Claims, 7 Drawing Sheets

WASTE LINE INSPECTION AND CLEAN OUT DEVICE WITH WATER JET HEAD

This is a Continuation of patent application Ser. No. 08/893,994 filed Jul. 16, 1997 now U.S. Pat. No. 5,862,561.

BACKGROUND OF THE INVENTION

1. Field of the Invention

The present invention relates generally to plumbers' tools of the type used to remove and clean away obstructions formed in and blocking waste lines. More particularly, the apparatus of the invention embodies an elongated coil spring wire which surrounds a flexible tube that functions as a water conduit. Affixed to the free end of the tube is a uniquely designed spray jet head assembly for controllably spraying jets of water under pressure into the interior of the waste line in a direction toward the blockage cutting component of the device to assist in breaking down the obstruction. The apparatus also includes a small video camera which is connected to the spray jet head to permit inspection of the waste line being cleaned.

2. Discussion of the Prior Art

A wide variety of waste line clean out devices have been suggested in the past. Normally the prior art waste line clean out devices embody an elongated clean out member known as a plumbers' snake. The plumbers' snake is ordinarily housed within a drum or hollow housing having an opening through which the spring or snake is fed and retracted actually of itself as the container is rotated. For tools having power operated spring advancing and retracting means, the feed mechanism for advancing the coiled spring typically includes jaws, rollers, segmented nuts or like structures which grip the spring so that when the spring is fed through the feed while being rotated it is controllably advanced into or retracted from the sewer line. As a general rule, cutter means affixed to the free end of the plumbers' snake and functions to cut away and clear blockages formed in the sewer line.

A very successful prior art waste clean out apparatus is described in U.S. Pat. No. 5,193,242 issued to the present inventor. This patent concerns an apparatus similar in some respects to the apparatus described in the present application, but does not contemplate the use of either high pressure water jets for aiding in the clearing blockages, nor does it contemplate means for visually inspecting the interior of the waste line. Because of its pertinence to the present invention, U.S. Pat. No. 5,193,242 is hereby incorporated by reference as though fully set forth herein.

U.S. Pat. No. 4,312,679 issued to Klein, Sr. describes a device for cleaning clogged pipes which includes an elongated flexible tube, a heavy coil surrounding the flexible tube and a nozzle at one end of the flexible tube. The nozzle has a plurality of perforations which are in communication with the interior of the flexible tube and which are oriented radially of the flexible tube. Unlike the apparatus of the present invention, the Klein device is specially designed for use in a method of cleaning a clogged pipe wherein the nozzle is first forced through the material clogging the pipe, water is then discharged through the perforations in the nozzle, and the nozzle is then pulled backwards towards the material clogging the pipe while water continues to be discharged through the perforations in the nozzle.

Other prior art patents which generally relate to clean out tools commonly known as "water snakes" are described in U.S. Pat. No. 3,370,599 issued to Ciaccio; U.S. Pat. No. 1,803,425 issued to Cunningham and U.S. Pat. No. 3,880,176 issued to Home.

In addition to waste line clean out devices discussed in the preceding paragraphs, various devices have been suggested for inspecting the interior walls of the sewer line. One such device is disclosed in U.S. Pat. No. 5,457,288 issued to Olsen. This apparatus uses electro-mechanical systems for inspecting the inside of pipes for defects and obstructions and more particularly discloses a push cable that mechanically and electrically connects a video camera head to a push reel and video circuit. The push cable of the device comprises an elongated, resiliently flexible push member and an elongated signal transmitting cable. In use, the video camera which is disposed proximate the free end of the push cable, permits visual inspection of the walls of the pipe as the push cable is pushed along the length of the pipe.

In addition to providing means for visually inspecting the interior walls of the waste line being cleaned, the novel apparatus of the present invention includes a unique high pressure jet water spray head which cooperates with a cutting element to remove obstructions in the waste line as the coil spring is urged forwardly of the waste line due to rotation of the drum housing which houses portions of the coil spring and in conjunction with the feeding mechanism.

Experience has shown that the use of strategically directed high pressure water jets materially assist in breaking up and clearing away troublesome obstructions. At the same time, the high pressure water jets function to effectively clean the walls of the waste line after the obstruction has been cleared to an extent to permit free flow of the cleaning water outwardly of the waste line. Since it is important that the spray jet nozzle and the cutting tool work in cooperation to effectively break up and clean away the obstruction so as to prevent the undesirable back-up of contaminated water, means must be provided to selectively interconnect various types of cutter devices to the device at a location proximate the high pressure water jet head that is affixed to the free end of the coiled spring.

The novel water jet head assembly of the invention includes a spray jet head having a plurality of water jet passageways that are angularly disposed relative to the axis of the waste line so that they will direct a plurality of high pressure water jets in the direction of the cutter component as the cutter component cuttably engages the obstruction in the water pipe. The water jet head also includes a reduced diameter portion having a plurality of helical grooves which comprise the means for interconnecting the coil spring with the water jet head.

Removably affixed to the spray jet head assembly of the apparatus of the present invention is a unique video camera component which is interconnected with an elongated electrical or fiber optic signal transmitting cable. The transmitting cable is uniquely housed within the water supply conduit that supplies water under pressure to the water jet nozzles of the spray jet head assembly. Portions of the coil spring which carries the water conduit, the optical signal transmitting cable and the power cable are housed in a rotatable drum having a conoidal wall through which the coil spring is fed and retracted actually of itself as the container is rotated.

The inboard end of the coil spring which houses the high pressure water conduit, the signal transmitting cable and the power cable is interconnected with a novel swivel assembly which, in turn, is interconnected to the drum that houses portion of the coil spring assembly. This novel swivel assembly, which permits water under pressure to be continuously supplied to the water conduit housed within the coiled spring also embodies a plurality of novel electrical interconnection means which permit power from an external source to provide to the video camera. Additionally, the swivel assembly permits signals from the video camera to be transmitted to a stationary viewing monitor disposed proximate the clean out apparatus.

SUMMARY OF THE INVENTION

It is an object of the present invention to provide an improved power driven machine of the type which comprises an elongated flexible coil spring formed of helically wound spring wire which can be controllably withdrawn from the machine for insertion into the pipe to be cleaned. The machine includes a one piece rotatable storage drum in which a portion of the coil spring can be conveniently housed. A forward guide portion is provided to pressurally engage the spring during operation of the machine and closely guide its withdrawal from an insertion into the storage drum.

A particular object of the present invention is to provide a waste line clean out apparatus of the aforementioned character in which a high pressure water jet spray head and a video camera assembly are attached to the free end of the coil spring. The high pressure spray jet head is strategically mounted so as to cooperate with a removably mounted cutter head that is also strategically affixed proximate the free end of the coil spring. The video camera is positioned forwardly of the spray jet assembly and rearwardly of the cutter blades.

Another object of the invention is to provide an apparatus of the character described in the preceding paragraph in which the high pressure water spray head is of a novel construction that causes high pressure water jets to impinge on the blockage and cutter head assembly in a manner to cooperate therewith to assist in the quick and effective removal and clearing away of the obstruction formed in the waste line being cleaned.

Another object of the invention is to apply an automatic feeding mechanism to urge the cable forward or reverse when under operation.

Another object of the invention is to provide a novel waste line inspection and water jet clean out apparatus which includes connector means for connecting the spray jet head with a water conduit leading to a source of water under pressure and for operably connecting the video camera to a viewing monitor.

Another object of the invention is to provide a device of the character described in which various cutter head assemblies of the device can be easily and quickly interconnected with the water spray head so as to enable the use of the most appropriately configured cutting means for clearing away the particular clogged sewer line at hand.

Another object of the invention is to provide a novel waste line inspection and clean out apparatus which embodies a unique automatic feed for advancing the clean out snake into the waste line to be cleaned.

Another object of the invention is to provide a water assisted sewer line clean out apparatus which is highly versatile, easy to use and relatively inexpensive to manufacture.

DESCRIPTION OF ONE FORM OF THE INVENTION

Figure 1:
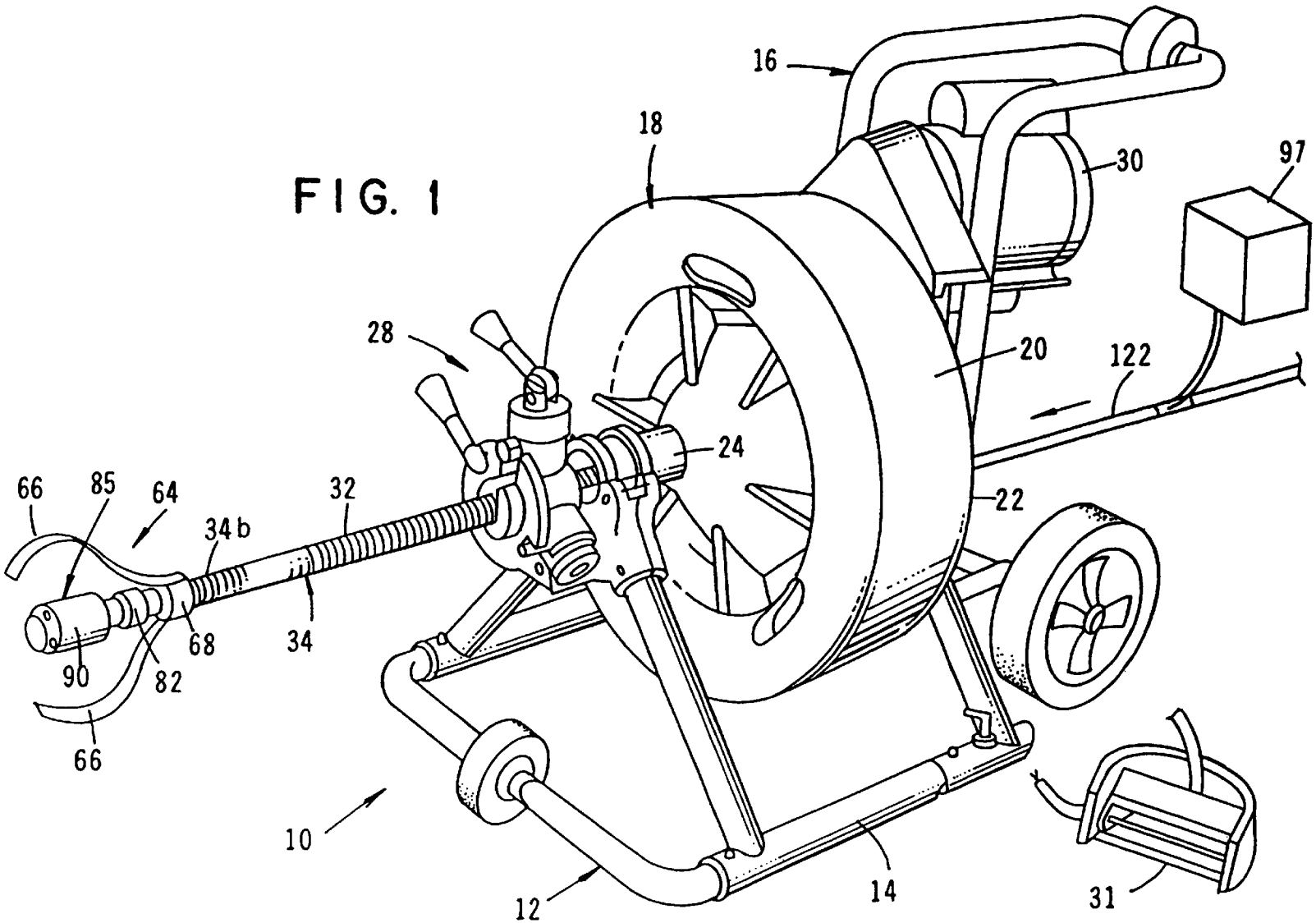
FIG. 1 is a generally perspective view of one form of the combination waste line inspection clean out apparatus of the present invention.
Figures 2, 3:
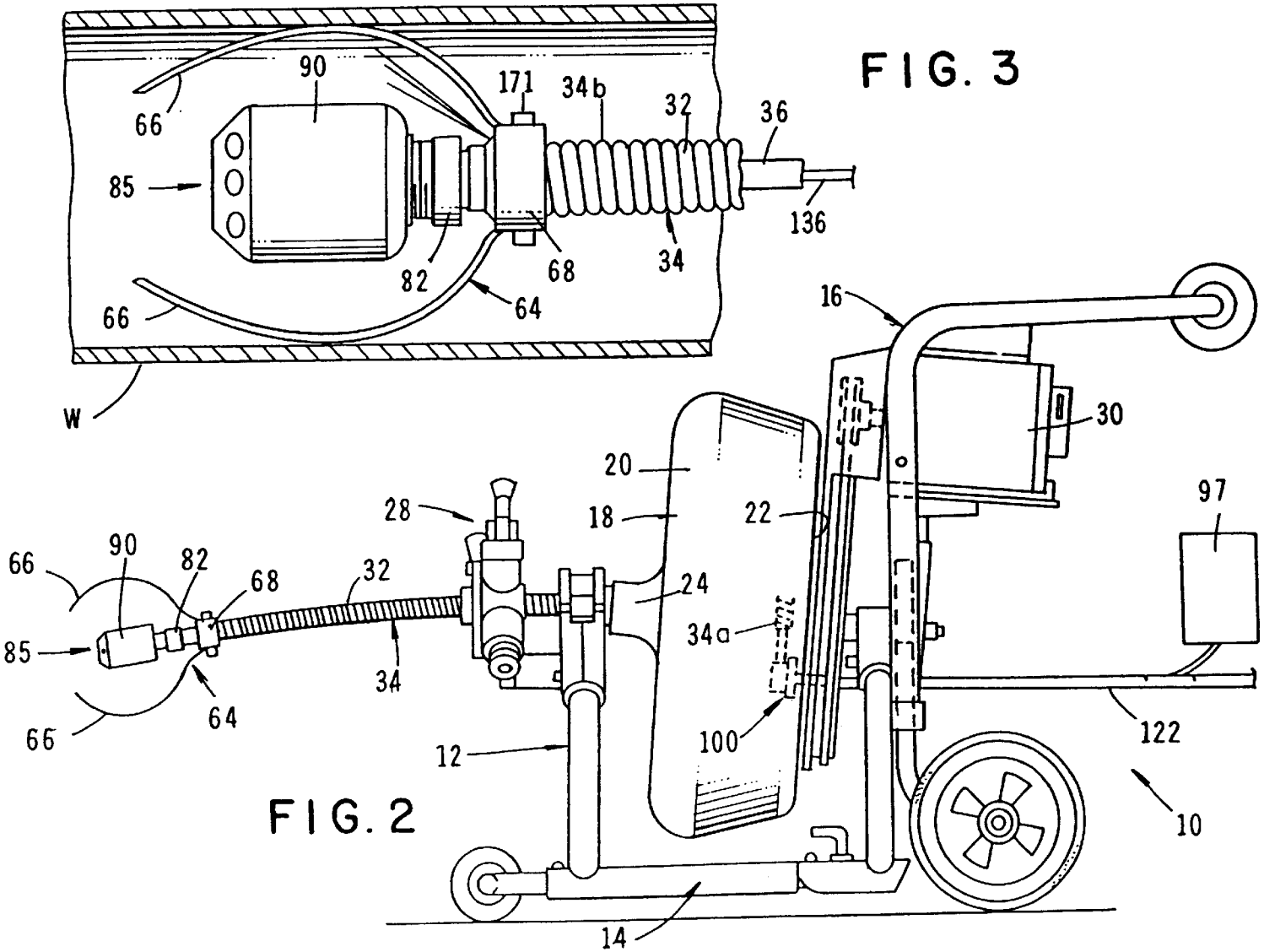
FIG. 2 is a side elevational view of the apparatus shown in FIG. 1.
FIG. 3 is a greatly enlarged view of the clean out head and video camera assembly of the invention as it appears when inserted into the waste line to be cleaned.

Referring to the drawings and particularly to FIGS. 1 and 2, one form of the combination waste line inspection and clean out apparatus of the present invention is there shown and generally identified by the numeral 10. The apparatus here comprises a supporting frame 12 having a base portion 14 and an upstanding, rearwardly disposed portion 16. Rotatably connected to upstanding portion 16 is a coil spring housing 18 which houses portions of the coiled spring, or plumbers' snake. Housing 18 is of the general character illustrated and described in the incorporated by reference U.S. Pat. No. 5,193,242 and includes a generally annular shaped body portion 20 having a rear wall 22 (FIG. 2) and a generally frustoconically shaped forward guide portion 24.

A feed means, generally designated by the numeral 28, is connected to frame 12 and fictions to engage the forward portion of the novel coil spring assembly of the invention in a manner to controllably withdraw the coil spring assembly from spring housing 18 and cause it to travel forwardly or reversely of the apparatus through the forward guide portion 24 of spring housing 18. The feed means of the present invention is identical to that described in incorporated by reference U.S. Pat. No. 5,193,242 and reference should be made to that patent for a detailed description of the construction and operation of this novel feed means. Similarly, the supporting frame 20 is of a construction generally similar to that shown in U.S. Pat. No. 5,193,242 and reference should be made to the patent for a more detailed discussion of the construction and assembly of the main supporting frame 12. A drive means comprising an electric motor 30 is carried by the upstanding portion 16 of frame 12 and can be energized by a foot switch 31 (FIG. 1) to controllably rotate spring housing 18 about the central axis thereof. Once again this drive means is of a generally similar construction to that described in U.S. Pat. No. 5,193,242.

Figures 7, 8:
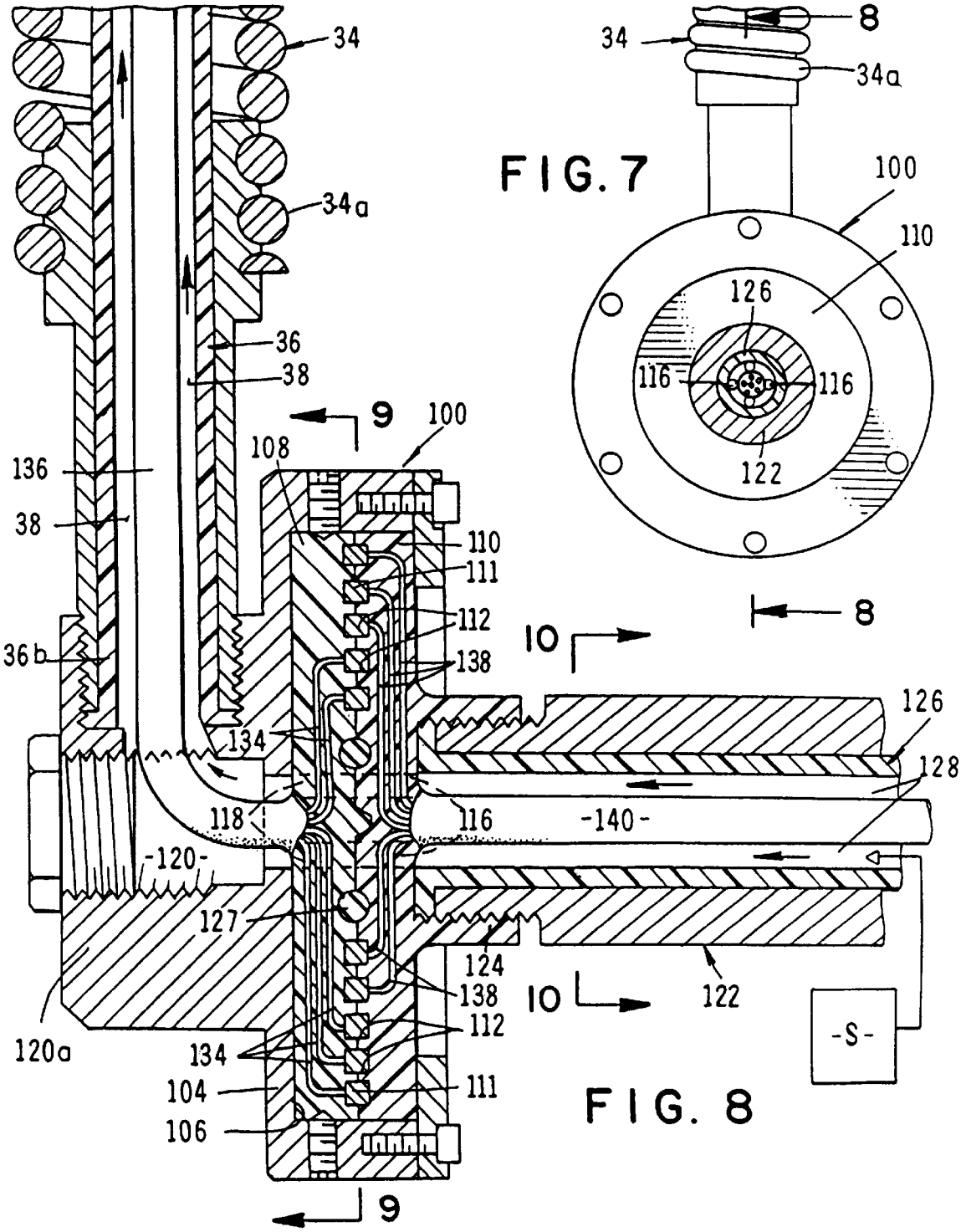
FIG. 7 is a front view of the fastener or swivel means of the invention for interconnecting the coil spring assembly and video camera with power, with a video monitor and with a source of water under pressure.
FIG. 8 is a greatly enlarged cross-sectional view taken along lines 8—8 of FIG. 7.

Forming a highly important aspect of the present invention is the novel coil spring assembly, which here includes an elongated, helically wound spring wire or plumbers' snake 32. During operation of the tool, snake 32 is forced down the waste line "W" (FIG. 3) so as to encounter and break up obstructions that have been formed internally of the waste line. Referring also to FIGS. 8 it can be seen that the coil spring assembly 34 has a rearward portion 34*a* which is disposed within the body portion 20 of spring housing 18 and a forward portion 34*b* which extends through the forward guide portion 24 of the spring housing and into the feed means 28.

Figures 4, 5:
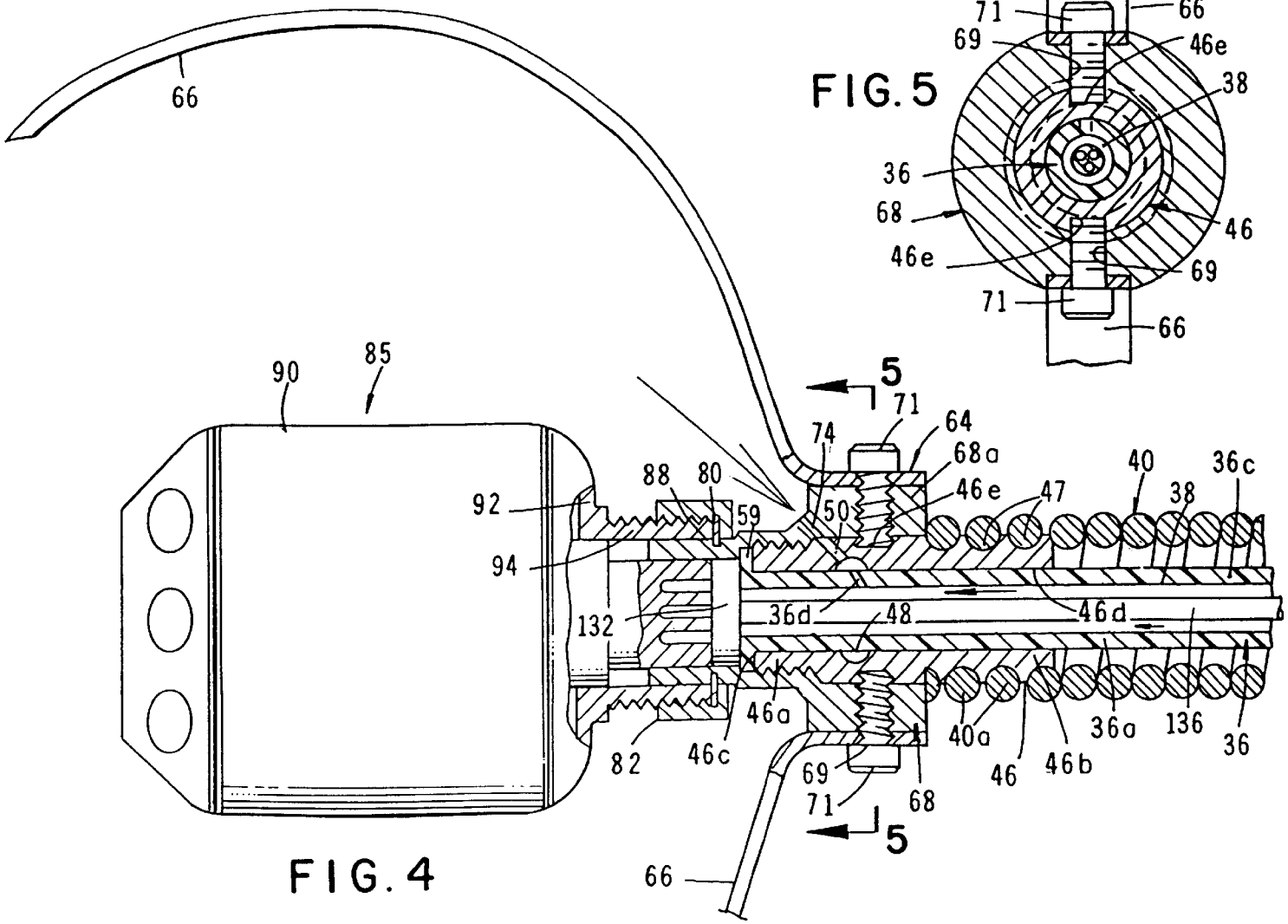
FIG. 4 is a greatly enlarged, top plan view, partly in cross section of the clean out head and video camera assembly shown in FIG. 3.
FIG. 5 is a cross-sectional view taken along lines 5—5 of FIG. 4.

As shown in FIGS. 4 and 8, coil spring assembly 34 includes an elongated, flexible elastomeric tube 36, having an internal fluid flow passageway 38. Tube 36 has a forward extremity 36*a* and a rearward extremity 36*b*, which, in a manner presently described, is connected to an external source "S" of water such as a domestic water supply. Helically wound about flexible tube 36 is an elongated spring wire 40 which closely circumscribes the external surface 36*c* of flexible tube 36 (FIG. 4). Spring wire 40 and the manner of helically coiling the wire about flexible tube 36 is well understood by those skilled in the art.

Interconnected proximate at the forward extremity of coil spring 40 and flexible tube 36 is the novel spray jet head of the invention which is generally designated in the drawings by the numeral 46. The spray jet head 46 here includes a forward externally threaded portion 46*a* and a rearward portion 46*b*. As best seen by referring to FIGS. 4 and 6, disposed between forward portion 46*a* and rearward portion 46*b* is an annular shaped fluid distribution chamber 48. Extending angularly outwardly from fluid distribution channel 48 is a first jet passageway 50 which directs water under pressure outwardly of head 46 in a direction toward an angularly extending jet passageway 52 formed in the cutter head assembly 56 which is threadably connected to a spray jet head 46.

Figure 6:
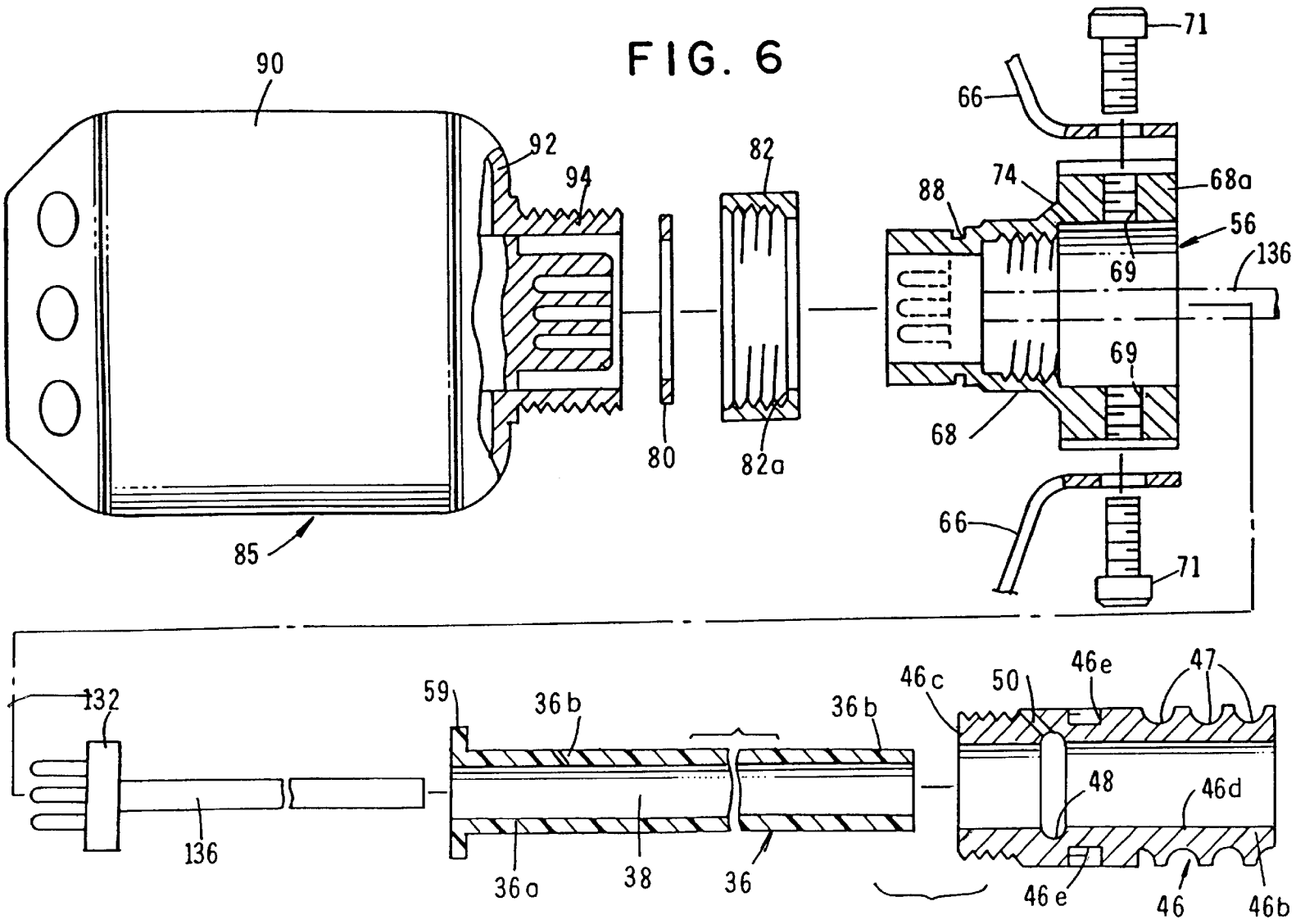
FIG. 6 is an exploded top plan view, partly in cross section of the clean out head and video camera assembly of the invention showing in greater detail the means for interconnecting the coil spring assembly with a source of electrical power and with a source of water under pressure.

As indicated in FIGS. 4 and 6 portions 46*b* of spray jet head 46, includes an external surface having a plurality of generally helically shaped groves 47 which receive a plurality of the wire coil spring 40*a* formed proximate the outboard extremity of coil spring 40. Groves 47 function to securely interconnect the spray jet assembly with the coil spring 40 in the manner shown in FIG. 4.

As shown in FIGS. 4 and 6, flexible tube 36 terminates at its forward end 36*a* in an enlarged diameter flange 59 which sealably engages forwardly facing shoulder 46*c* of spray jet head 46, which tube 36 is telescopically received within bore 46*d* in the manner shown in FIG. 4. With this construction, the spray jet head is sealably connected to flexible tube 36 in a manner to place the internal passageway 38 of the tube in free fluid communication with the source "S" of water under pressure. When tube 36 is telescopically received within bore 46*d* of head 46, a fluid passageway 36*d* is indexably aligned with fluid channel 48 of head 46 so that water under pressure flowing through the tube will flow through passageway 36*d*, into channel 48 and outwardly toward jet passageway 50. Flexible tube 36 can be constructed from a wide variety of materials, including various metals, elastomers and plastics.

Threadably connected to the forward portion 46*a* of spray jet head 46, is a novel cutter means for cutting into and removing obstructions such as clogs formed in the waste line "W" being cleaned. In the present form of the invention the cutter means comprises a specially shaped cutter blade assembly 64, which includes outwardly extending curved cutter blades 66. Connector member 68, which comprises the connector means of the invention closely telescopically receives and is threadably connected to the forwardly disposed, externally threaded portion 46*a* of spray jet head 46. To removably interconnect the cutter blades 66 with connector member 68, the elongated diameter rearward portion 68*a* of the member is provided with circumferentially spaced, threaded bores 69 which receive threaded connectors 71. Connectors 71 function to interconnect blades 66 with connector member 68 in the manner shown in FIGS. 4 and 5. The extremities of connectors 71 will seat into counterbores 46*e* formed in member 46 to correctly index the components.

When the cutter means is appropriately connected to spray jet head 46, an angularly disposed second spray jet passageway 74 formed in member 68 will align with passageway 50 of member 46 (FIG. 4). Similarly, when member 68 is threadably interconnected with spray jet head 46, flange 59 of tube 36 will be sealably clamped against shoulder 46*c* of head 46.

Connected to forward portion of connector 68 by means of a split ring 80 and internally threaded collar 82 is the important video camera means of the invention for use in viewing the interior of the waste line being cleaned. This video camera means here comprises a video camera assembly 85 the character of which will presently be described. In the manner shown in FIG. 4, split ring 80, which is received within a groove 88 formed in member 68, functions to engage a shoulder 82*a* on collar 82 to hold the collar in position relative to member 68 so that the video camera 90 can be removably coupled with the connector member 68. For this purpose, external housing 92 of camera 90 is provided with an externally threaded neck 94 which is threadably received within collar 82.

Video camera 90 is of a character well known in the art and is readily commercially available from several sources including Screco Flexible of Lima, Ohio. A suitable camera for the present application is sold by Screco Flexible as Part No BV-101. However, it is to be understood that other types of video cameras can also be used with the apparatus shown in the drawings.

Figure 9:
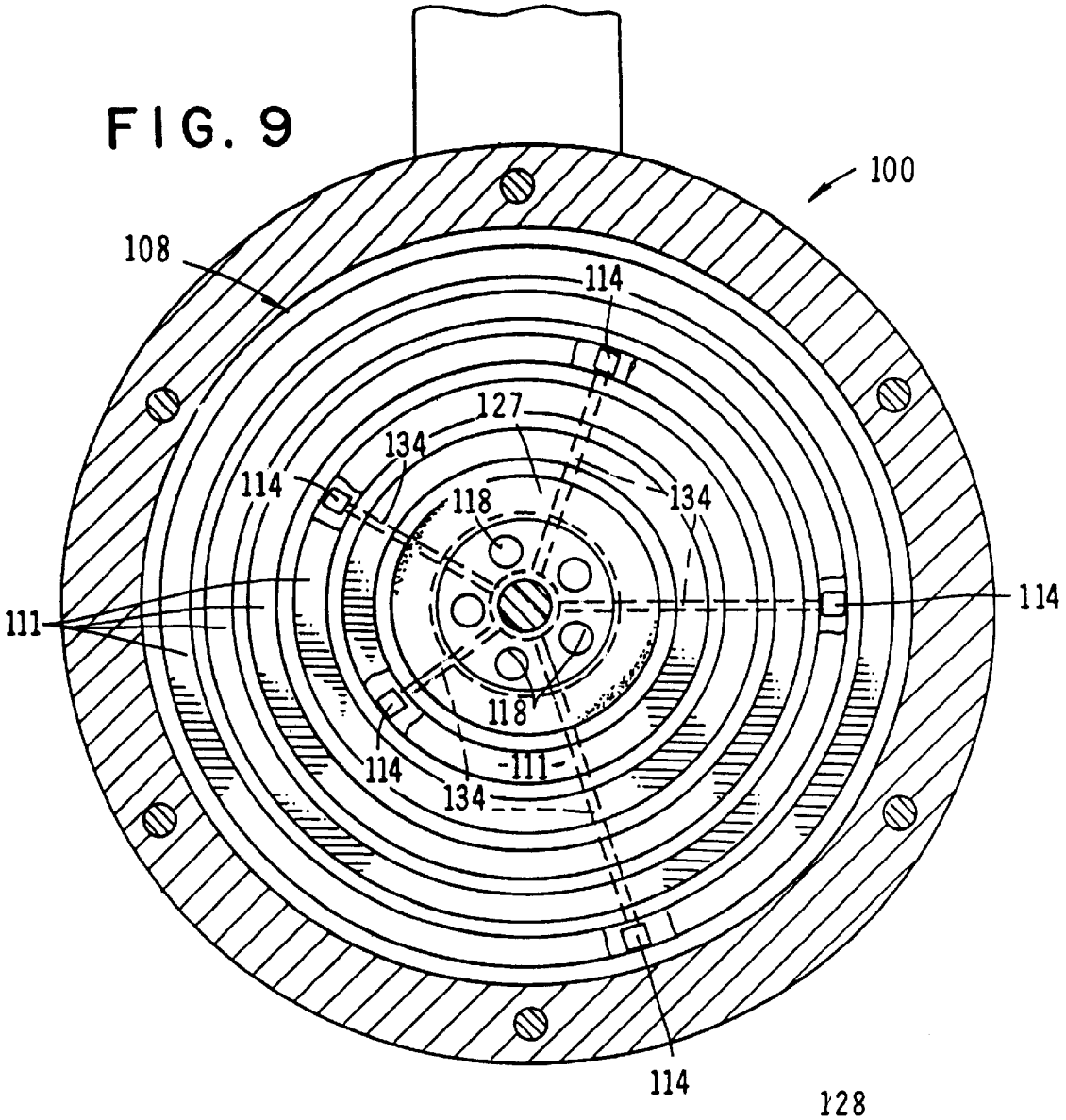
FIG. 9 is a cross-sectional view taken along lines 9—9 of FIG. 8.
Figure 10:
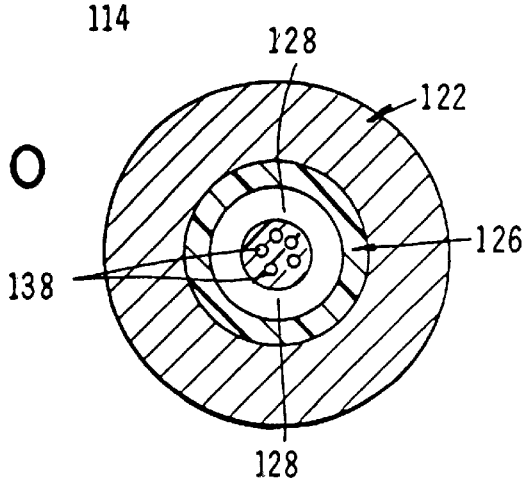
FIG. 10 is a cross-sectional view taken along lines 10—10 taken along lines 10—10 of FIG. 8.

Turning next to FIGS. 7 through 12, the important swivel transfer means of the invention for connecting the internal passage way 38 of tube 36 with a source of water under pressure and for operatively interconnecting the video camera 90 with a monitor 97 and with a source of power (see also FIG. 1). In the present form of the invention, the swivel transfer means comprises a housing 100 disposed within spring housing 18 (FIG. 2). Housing 100 includes a hollow, internally threaded hub portion 102 and a chamber defining portion 104 which defines a hollow chamber 106. Disposed within chamber 106 are two sealably interconnected, relatively rotatable first and second swivel plates 108 and 110 respectively. As best seen in FIG. 9, first swivel plate 76 is provided with a plurality of radially spaced apart concentric transfer grooves 112. In a manner presently to be discussed, a plurality of radially spaced transfer contacts 114 carried by swivel plate 108 are adapted to operatively engage connector rings 111 disposed within grooves 112 as plate 108 rotates relative to plate 110.

Also formed in swivel plates 108 and 110 are a plurality of aligned, circumferentially spaced fluid passageways 116 and 118 respectively. These passageways communicate with the internal fluid chamber 120 which is defined by hollow hub portion 120*a* and also communicate with a plurality of fluid passageways 38 formed in flexible tube 36 (FIG. 8).

Also forming a part of the transfer means of this form of the invention is means for connecting second fluid passageways 116 of swivel plate 110 with a remotely located source of fluid "S" under pressure. This latter means comprises an elongated tube 122 which is threadably connected to an internal threaded hub 124 formed on swivel plate 110 (FIG. 8). Housed within tube 122 is a second tube 126 which includes a plurality of circumferentially spaced internal fluid passageways 128 (see also FIG. 10). In a manner well understood by those skilled in the art, tubes 122 and 126 can be interconnected with a source of water under pressure, such as a domestic water source generally illustrated in FIG. 8 and designated by the letter "S". An elastomeric "O" ring 127 sealably interconnects plates 108 in the manner shown in FIG. 8 to prevent leakage of water therebetween.

Figure 11:
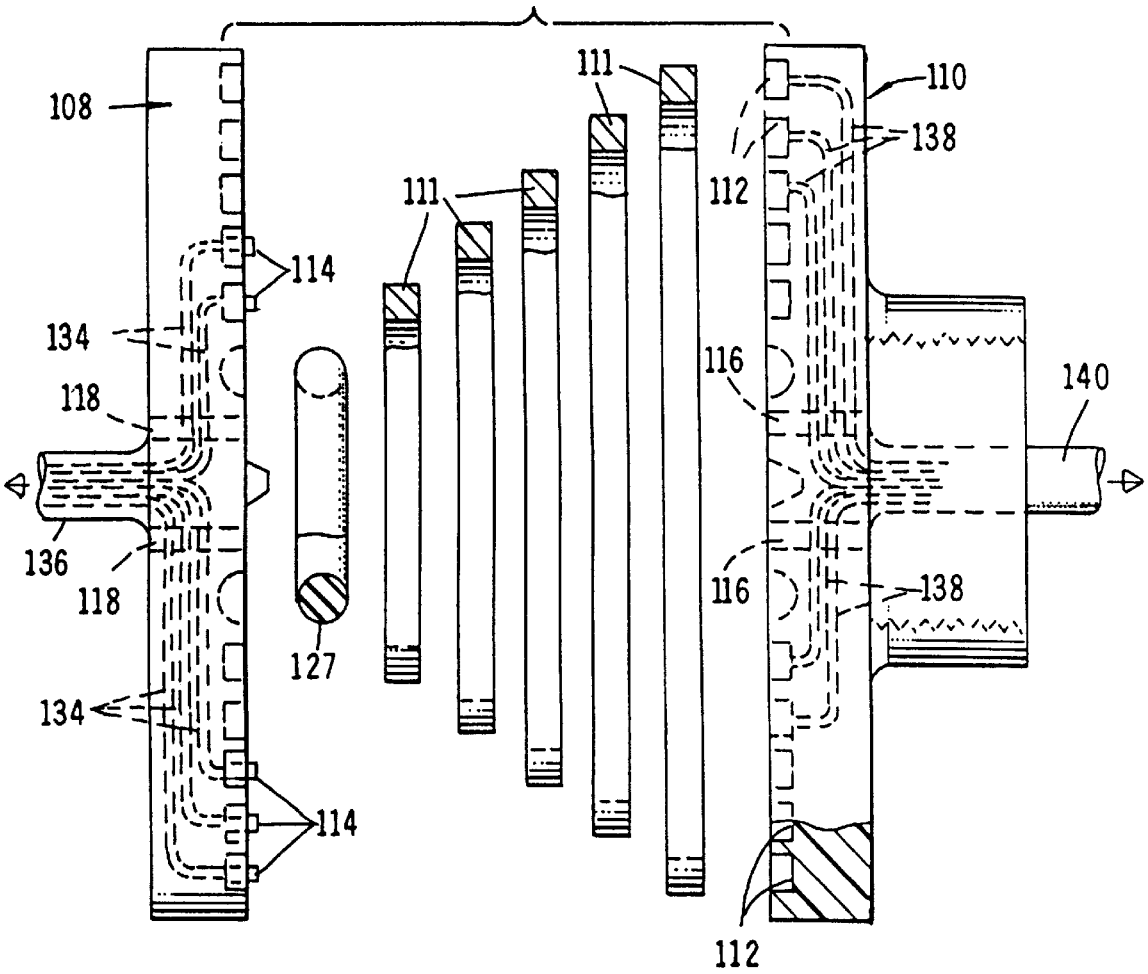
FIG. 11 is a side-elevational, exploded view of a portion of the swivel assembly shown in FIG. 8.
Figure 12:
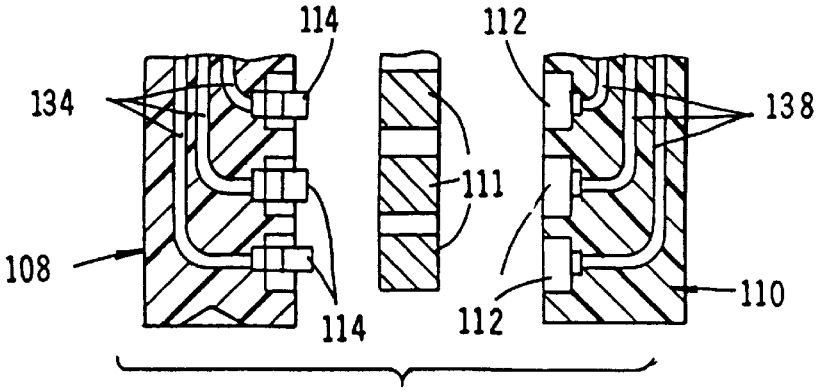
FIG. 12 is an enlarged fragmentary, side-elevational cross-sectional view of one set of electrical contacts and mating grooves of the swivel head assembly.

Turning particularly to FIGS. 4 and 8, it can be seen that the previously identified transfer contacts 114 are interconnected with a multi-prong connector plug 132 by means of a plurality of connect conduits 134 which are encased within a waterproof protector sheath 136 (see also FIG. 11). Similarly, transfer rings 111 are interconnected with a plurality of connector conduits 138, which include fiber optic signal transmitting cables are encased within a waterproof protector sheath 140. Connector conduits 138, which are appropriately, selectively interconnected with a source of power, with a viewing means here shown as video monitor 97 and with ground, function to power video camera 90 and to transmit video signals therefrom via the fiber optic signal transmitting cables to monitor via connector plug 132. As shown in FIG. 4, connector plug 132 is operably coupled with camera 90 in the manner well known in the art. In this regard, plug 132 and connector conduits 134 and 138 are readily commercially available from sources such as Screco Flexible and Scooter Cam Northcut Co. of Tehachapi, Calif. The details of the interconnection of the various conduits and cables with the camera, with the monitor and with power and ground are well understood by those skilled in the art and need not be here discussed. Suffice to say that by selectively interconnecting the various contacts 114 with selective transfer rings 111 in the manner shown in FIGS. 9, 11, and 12, the appropriate interconnection of conduits 134 with conduits 138 can be achieved as swivel plate 108 rotates relative to swivel plate 110.

With the waste line clean out apparatus in the assembled configuration shown in FIG. 2, cleaning of the clogged waste line "W" can be accomplished by first inserting the cutter means along with the outboard end of the coil spring assembly into the waste line to be cleaned in the manner shown in FIG. 3. This done, using foot switch 31, motor 30 is energized to cause rotation of spring housing 18 and rotation of the coil spring assembly housed therewithin. It is to be understood as housing 18 rotates, the swivel transfer means of the invention, which is disposed within spring housing 18, will also rotate as will the portion of the coil spring which is initially coiled within hollow spring housing 18. Operation of the feed means 28 will then cause the coil spring to be controllably withdrawn from the spring housing and advanced through the waste line to be cleaned via guide portion 24 and feed means 28.

Upon the cutter means engaging the obstruction within the waste line water from pressurized water source "S" is introduced into passageway 128 of tube 126. Tube 126 as well as first swivel plate 110 are, of course, stationary. However, due to the fact that drum 18 is being rotated by electric motor 30, swivel plate 108 will also be rotated relative to plate 108 will also be rotated relative to plate 110 in a manner such that water flowing through passageways 128 and plate 110 will flow freely through passageways 118 formed in plate 108 and thence into passageway 38 of flexible tube 36. As indicated in FIG. 8, the water from the domestic water source "S" will flow around and about waterproof sheath 136. Water under pressure flowing through passageway 38 will flow through jet passageway **36*d* formed in tube 36 into annular groove 48 and then outwardly under pressure through jet passageway 50 and 74 (FIG. 4). This water flowing through passageways 50 and 74 is strategically directed toward the cutting means or blades 66 so as to assist in the breakdown and clearing away obstructions formed within the waste line. By strategically directing the high pressure jets of water toward the obstruction and toward the cutting blades 66**, significant cutting improvement of the cutting means is achieved and at the same time clearing of the obstruction is greatly facilitated.

Prior to cutting blades 66 encountering the waste line blockage, camera 90 will transmit video images to monitor 97 in a manner well understood by those skilled in the art so that the appropriateness of blades 66 can be determined. If, for example, the operator determines that blades 66 are not properly configured to cut into the blockage in the waste line, the coil spring assembly can be withdrawn from the line, and other cutter blades affixed to member 68.

After the waste line blockage has been removed, camera 90 can be used to inspect the interior of the waste line for damage and can be used to verify complete removal of the blockage. Camera 90 can also be used to visually locate branch lines and to verify the integrity of the waste line along its length.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A waste line clean out tool comprising:

(a) a supporting frame;

(b) a spring housing rotatably mounted on said supporting frame;

(c) a coiled spring assembly having a portion thereof extending outwardly of said spring housing, said coiled spring assembly comprising:

(i) an elongated flexible tube defining an internal passageway;

(ii) an elongated helically wound spring wire wound about said elongated flexible tube and;

(iii) a spray jet head having a forward portion and a rearward portion said rearward portion being connected to said flexible tube and to said spring wire, said spray jet head having at least one jet passageway formed therein;

(d) camera means connected to said coiled spring assembly for providing images of the interior of the waste line;

(e) viewing means operably associated with said camera means for viewing said images provided by said camera means;

(f) transfer means connected to said coiled spring assembly for connecting said spray jet head with a source of water and for interconnecting said camera means with said viewing means; and (g) feed means connected to said frame for feeding said coiled spring assembly into the waste line.

2. A tool as defined in claim 1 further including drive means connected to said frame for rotating said spray housing about the central axis thereof.

3. A tool as defined in claim 1 in which said connector means comprises a generally tubular shaped member having a first portion connected to said spray jet head and a second forward portion, said camera means being connected to said second forward portion.

4. A tool as defined in claim 1 in which said transfer means comprises;

(a) a housing disposed with said spring housing and rotatable therewith, said housing having a hollow hub portion and a chamber defining portion defining a hollow chamber;

(b) first and second relatively rotating swivel plates mounted within said hollow chamber of said housing, said swivel plates having communicating water passageways;

(c) plates having communicating water passageways; means for connecting said flexible tube to said hollow hub portion; and (d) means for connecting said water passageways of said first and second swivel plates with a source of water.

5. A tool as defined in claim 1 in which said connector means includes a second jet passageway in fluid communication with said first jet passageway of said spray jet head.

6. A waste line clean out and inspection tool comprising:

(a) a supporting frame;

(b) a spring housing rotatably mounted on said supporting frame;

(c) a coiled spring assembly having a rearward portion disposed within said spring housing and a forward portion extending outwardly of said spring housing, said coiled spring assembly comprising:

(i) an elongated flexible tube defining an internal passageway;

(ii) an elongated helically wound spring wire wound about said elongated flexible tube;

(iii) a spray jet head having a forward portion and a rearward portion said rearward portion being connected to said flexible tube and to said spring wire, said spray jet head having a first jet passageway formed therein and;

(d) camera means connected to said forward portion of said coiled spring assembly for providing images of the interior of the waste line;

(e) viewing means operably associated with said camera means for viewing said images provided by said camera means;

(f) transfer means connected to said coiled spring assembly for connecting said spray jet head with a source of water and for interconnecting said camera means with said viewing means, said transfer means comprising:

(i) a housing disposed with said spring housing and rotatable therewith, said housing having a hollow hub portion and a chamber defining portion defining a hollow chamber;

(ii) first and second relatively rotating swivel plates mounted within said hollow chamber of said housing, said swivel plates having communicating water passageways;

(iii) plates having communicating water passageway means for connecting said flexible tube to said hollow hub portion; and (iv) means for connecting said water passageways of said first and second swivel plates with a source of water;

(g) feed means connected to said frame to controllably withdrawing a portion of said coiled spring assembly from said spray housing through said forward guide portion thereof; and (h) drive means connected to said frame for rotating said spray housing about the central axis thereof.

7. A tool as defined in claim 6 in which said camera means comprises a small video camera.

8. A tool as defined in claim 6 in which one of said rotating swivel plates of said transfer means is provided with a plurality of concentric grooves and the other of said swivel plates is provided with a plurality of radially spaced contacts.

9. A tool as defined in claim 8 in which a transfer ring is carried within each of said concentric grooves and in which said radially spaced contacts engage said transfer rings.

10. A tool as defined in claim 8 in which said connector means includes a second jet passageway in fluid communication with said first jet passageway of said spray jet head.

11. A tool as defined in claim 10 in which said connector means includes an internally threaded portion and in which said spray jet head includes an externally threaded portion connected thereto, said connector means further including an internally threaded collar interconnectable with said camera means.

12. A waste line clean out and inspection tool comprising:

(a) a supporting frame;

(b) a spring housing rotatably mounted on said supporting frame;

(c) a coiled spring assembly having a rearward portion disposed within said spring housing and a forward portion extending outwardly of said spring housing, said coiled spring assembly comprising:

(i) an elongated flexible tube defining an internal passageway;

(ii) an elongated helically wound spring wire wound about said elongated flexible tube; and (iii) a spray jet head having a forward portion and a rearward portion said rearward portion being connected to said flexible tube and to said spring wire, said spray jet head having an outwardly extending first jet passageway formed therein;

(d) camera means comprising a small video camera connected to said forward portion of said coiled spring assembly for providing images of the interior of the waste line;

(e) viewing means connected to said frame for viewing said images provided by said camera means;

(f) transfer means connected to said coiled spring assembly for connecting said spray jet head with a source of water and for interconnecting said camera means with said viewing means, said transfer means including a plurality of conduits disposed within said internal passageway of said elongated flexible tube, said transfer means comprising:

(i) a housing disposed with said spring housing and rotatable therewith, said housing having a hollow hub portion and a chamber defining portion defining a hollow chamber;

(ii) first and second relatively rotating swivel plates mounted within said hollow chamber of said housing, said swivel plates having communicating water passageways, one of said swivel plates having a plurality of concentric grooves and the other of said swivel plates being provided with a plurality of radially spaced contacts;

(iii) means for connecting said flexible tube to said hollow hub portion; and (iv) means for connecting said water passageways of said first and second swivel plates with a source of water;

(g) feed means connected to said frame for removable engagement with said forward portion of said coiled spring assembly to controllably withdraw a portion of said coiled spring assembly from said spray housing through said forward guide portion thereof; and (h) drive means connected to said frame for rotating said spray housing about the central axis thereof.

13. A tool as defined in claim 12 further including connector means for connecting cutter blades to said spray jet head.

14. A tool as defined in claim 13 in which said connector means comprises a generally tubular shaped member having a first portion connected to said spray jet head.

15. A tool as defined in claim 14 in which said spray jet head is provided with external threads and in which said connector means includes internal threads for threadably receiving said external threads of said spray jet head.

* * * * *